US008613464B2

(12) United States Patent
Blakeman

(10) Patent No.: US 8,613,464 B2
(45) **Date of Patent: *Dec. 24, 2013**

(54) PERSONALIZABLE STACKED TIRE ICE CHEST, AND METHODS OF CONSTRUCTING AND UTILIZING SAME

(76) Inventor: Ken Blakeman, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/491,637

(22) Filed: Jun. 8, 2012

(65) Prior Publication Data

US 2012/0241345 A1 Sep. 27, 2012

Related U.S. Application Data

(62) Division of application No. 12/573,104, filed on Oct. 3, 2009, now Pat. No. 8,196,951.

(51) Int. Cl.
*B62B 5/00* (2006.01)

(52) U.S. Cl.
USPC ..... 280/655; 280/30; 280/42.26; D7/606

(58) Field of Classification Search
USPC ..... 280/655, 30, 47.26, 87.043, 79.2; D7/606, 604, 514
See application file for complete search history.

(56) References Cited

U.S. PATENT DOCUMENTS

| | | | |
|---|---|---|---|
| D198,676 | S | 7/1964 | Tarran |
| 3,456,960 | A | 7/1969 | Rector |
| D231,523 | S | 4/1974 | Baker |
| D249,031 | S | 8/1978 | Tarran |
| D249,032 | S | 8/1978 | Tarran |
| 4,164,284 | A | 8/1979 | Witt et al. |
| 4,513,895 | A | 4/1985 | Leslie |
| 4,776,603 | A | 10/1988 | Watts |
| 4,974,862 | A | 12/1990 | Maupin |
| D349,008 | S | 7/1994 | Minor |
| D349,009 | S | 7/1994 | Minor |
| D349,629 | S | 8/1994 | Redmon |
| D349,630 | S | 8/1994 | Redmon |
| D349,631 | S | 8/1994 | Redmon |
| D370,391 | S | 6/1996 | Bauer et al. |
| D371,934 | S | 7/1996 | Cwirko |
| D378,562 | S | 3/1997 | Miller et al. |
| 5,626,352 | A | 5/1997 | Grace |
| 5,803,472 | A | 9/1998 | Lien |
| D401,117 | S | 11/1998 | Anderson et al. |
| D409,050 | S | 5/1999 | Anderson et al. |
| D419,389 | S | 1/2000 | Hanson |
| D424,375 | S | 5/2000 | D'Arrigo |
| D425,757 | S | 5/2000 | Printz et al. |
| 6,237,925 | B1 | 5/2001 | Koenig |

(Continued)

FOREIGN PATENT DOCUMENTS

DE 29811256 U1 12/1998

*Primary Examiner* — Hau Phan
(74) *Attorney, Agent, or Firm* — Weiner & Burt PC; Irving M. Weiner; Pamela S. Burt

(57) ABSTRACT

A personalizable stacked tire shaped ice chest having a main ice chest housing and a selectively openable and closable lid member pivotably secured to the housing. The ice chest has a personalizable stacked tire shape, wheels rotatably secured to the housing, a collapsible pull handle mechanism connected to the housing, and areas on the housing and lid member for the placement of a logo or emblem.

20 Claims, 2 Drawing Sheets

(56) References Cited

U.S. PATENT DOCUMENTS

| | | | | |
|---|---|---|---|---|
| D452,120 | S | 12/2001 | Brangle et al. | |
| D453,602 | S | 2/2002 | Chang | |
| 6,474,097 | B2 | 11/2002 | Treppedi et al. | |
| 6,497,424 | B2 | 12/2002 | Gartner et al. | |
| 6,530,740 | B2 | 3/2003 | Kim | |
| 6,752,404 | B1 | 6/2004 | Blake | |
| 6,802,149 | B1 | 10/2004 | Albanese, Jr. et al. | |
| D519,789 | S | 5/2006 | Thiele | |
| D521,322 | S | 5/2006 | Loving | |
| D530,571 | S | 10/2006 | Henmann et al. | |
| D536,219 | S | 2/2007 | Gearing | |
| 7,387,608 | B2 | 6/2008 | Dunlop et al. | |
| 7,398,990 | B2 | 7/2008 | Tsai | |
| 7,407,032 | B1 | 8/2008 | Chambers et al. | |
| D575,965 | S | 9/2008 | Weldon | |
| 7,464,947 | B2 | 12/2008 | Cortese | |
| D589,765 | S | 4/2009 | Zuloff | |
| 7,603,875 | B2 | 10/2009 | Carr | |
| D613,128 | S | 4/2010 | Blakeman | |
| 7,823,893 | B2 | 11/2010 | Meyers et al. | |
| 7,934,730 | B2 | 5/2011 | Francis et al. | |
| D644,397 | S | 8/2011 | Wood et al. | |
| D644,398 | S | 8/2011 | Wood et al. | |
| D644,400 | S | 8/2011 | Wood et al. | |
| D644,401 | S | 8/2011 | Dechant et al. | |
| 8,196,951 | B2 * | 6/2012 | Blakeman | 280/655 |
| 2002/0060438 | A1 | 5/2002 | Gartner et al. | |
| 2003/0168371 | A1 | 9/2003 | Weimer | |
| 2005/0268622 | A1 * | 12/2005 | Krieger | 62/3.6 |
| 2005/0279123 | A1 | 12/2005 | Maldonado et al. | |
| 2010/0263398 | A1 | 10/2010 | Webb | |

* cited by examiner

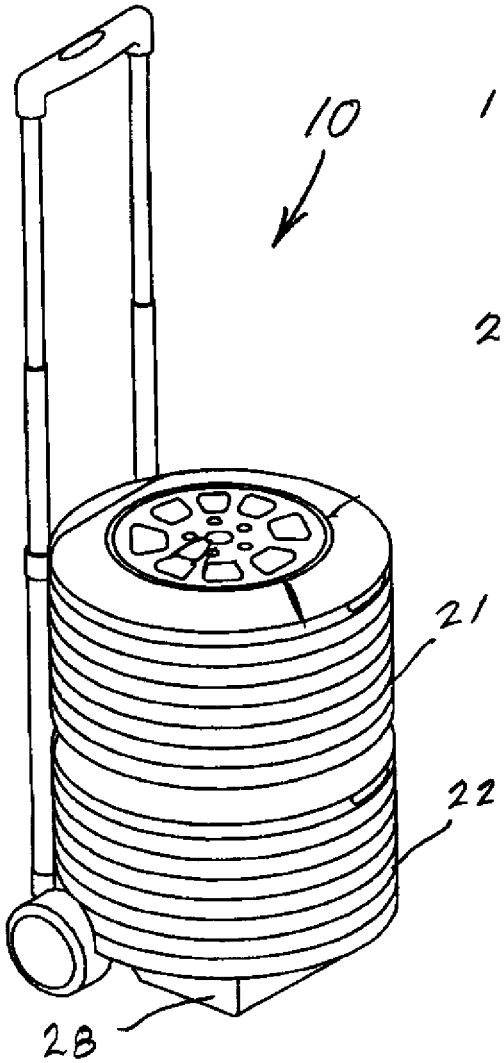
FIG. 1
FIG. 2
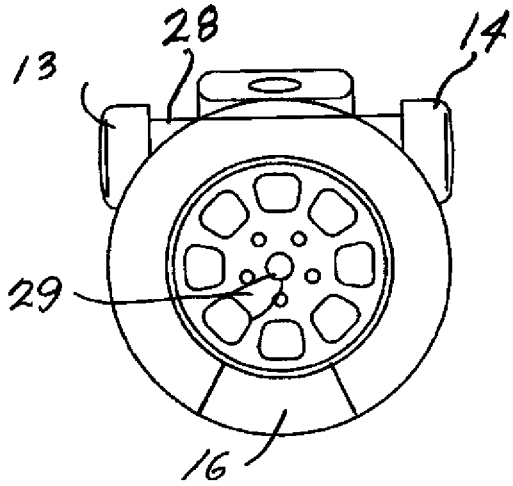
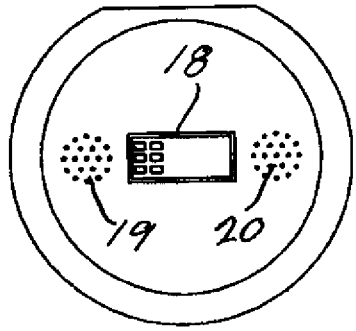
FIG. 3

PERSONALIZABLE STACKED TIRE ICE CHEST, AND METHODS OF CONSTRUCTING AND UTILIZING SAME

CROSS-REFERENCE TO RELATED APPLICATIONS

This application is a division of and claims priority from U.S. patent application Ser. No. 12/573,104 filed Oct. 3, 2009 now U.S. Pat. No. 8,196,951.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The phrase "a renewable resource" as used herein means any renewable resource, including, but not limited to, corn sugar or a fibrous residue remaining after sugarcane or sorghum stalks are crushed to extract their juice.

The present invention relates to a novel and unique personalizable stacked tire shaped ice chest, and methods of constructing and utilizing same.

It is a desideratum of the present invention to avoid the animadversions of conventional ice chests, and at the same time to provide a very convenient and unique personalizable stacked tire shaped ice chest.

SUMMARY OF THE INVENTION

The present invention provides a personalizable sports themed ice chest, comprising: a main ice chest housing having a selectively openable and closable lid member pivotably secured to said main ice chest housing; said main ice chest housing and said selectively openable and closable lid member being formed in a personalizable shape of stacked tires; wheels rotatably secured to said main ice chest housing under said main ice chest housing to enable said personalizable sports themed ice chest to be rolled by a user of said personalizable sports themed ice chest; a supporting stand member integral, unitary and contiguous with and depending directly from said personalizable stacked tire shaped main ice chest housing; said supporting stand member being oriented substantially perpendicular to a central vertical axis of said personalizable stacked tire shaped main ice chest housing; said central vertical axis of said personalizable stacked tire shaped main ice chest housing being oriented substantially in line with a midpoint of said supporting stand member; said supporting stand member having an uppermost surface which is contiguous with and is integral and unitary with a lower portion of said personalizable stacked tire shaped main ice chest housing; said supporting stand member having a flat planar lowermost surface which is co-planar with a lowermost portion of said wheels; said flat planar lowermost surface of said supporting stand member is oriented substantially perpendicular to said central vertical axis of said personalizable stacked tire shaped main ice chest: a collapsible pull handle mechanism connected to said main ice chest housing; and one or more predetermined areas on said personalizable stacked tire shaped main ice chest housing for the placement thereon of a logo or emblem.

One object of the present invention is to provide an ice chest as described above which includes a mini recorder within the lid compartment.

Another object of the present invention is to provide an ice chest as described above which includes speakers built into the ice chest lid.

Yet another object of the present invention is to provide an ice chest as described above which includes a collapsible pull handle mechanism connected to the main ice chest housing, and one or more predetermined areas on the main ice chest housing for the placement thereon of a personalizable logo or emblem.

Other objects, advantages, and features of the present invention will become apparent to those persons skilled in this particular area of technology and to other persons after having been exposed to the present patent application when read in conjunction with the accompanying patent drawings.

BRIEF DESCRIPTION OF THE DRAWINGS

FIG. 1 is a perspective view of a first embodiment of the present invention.

FIG. 2 is a top plan view of the apparatus depicted in FIG. 1.

FIG. 3 shows the underside of the lid.

DETAILED DESCRIPTION OF THE INVENTION

Figure 4:
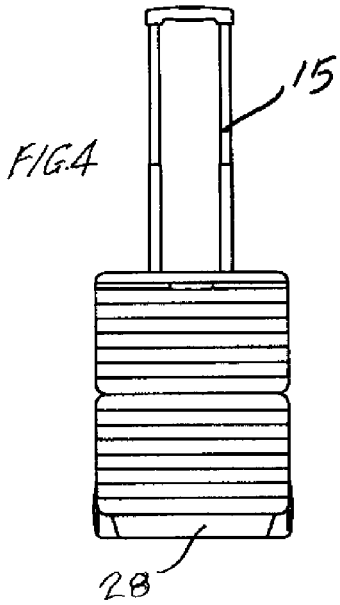
FIG. 4 is a front elevational view of the FIG. 1 apparatus.
Figure 5:
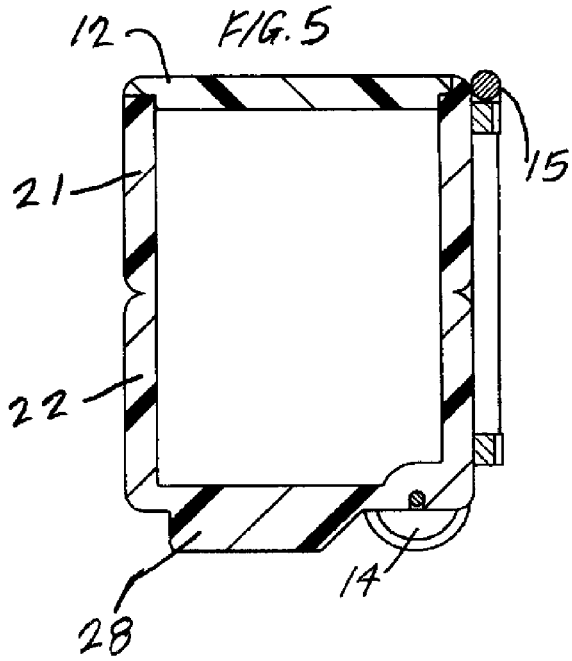
FIG. 5 is a cross-sectional view of the apparatus with the handle fully collapsed.
Figure 6:
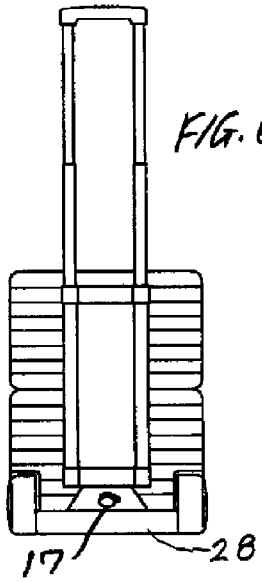
FIG. 6 is a rear elevational view of the FIG. 1 apparatus.
Figure 7:
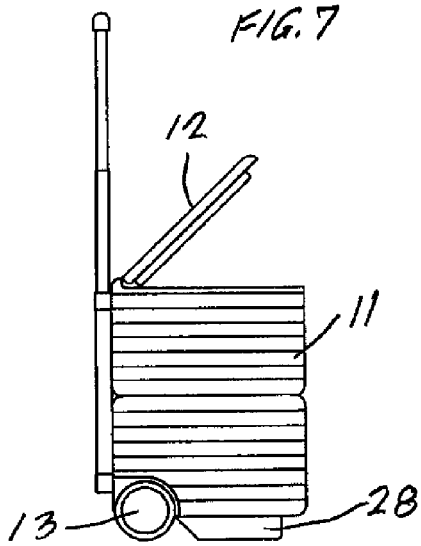
FIG. 7 is a side elevational view with the lid partially open.

With reference to FIGS. 1-7, there is shown a personalizable sports themed ice chest 10 in accordance with a first embodiment of the invention.

The chest 10 includes a main ice chest housing 11 having a selectively openable and closable lid member 12 pivotably secured to the main ice chest housing 11.

The main ice chest housing 11 and said selectively openable and closable lid member 12 are formed in a personalizable sports related shape, which in this case are stacked tires 21 and 22 for a user interested in the sport of auto racing.

Wheels 13 and 14 rotatably secured to said main ice chest housing 11 under said main ice chest housing 11 to enable the personalizable sports themed ice chest 10 to be rolled by a user of the personalizable sports themed ice chest 10.

A collapsible pull handle mechanism 15 is connected to said main ice chest housing 11.

As best seen in FIGS. 1, 4, 6 and 7, there is provided a supporting stand member 28 which is unitary with the housing 11.

The supporting stand member 28 is oriented substantially perpendicular to a central vertical axis of the personalizable stacked tire shaped main ice chest housing 11.

The central vertical axis of the personalizable stacked tire shaped main ice chest housing 11 being oriented substantially in line with a midpoint of the supporting stand member 28.

The supporting stand member 28 has an uppermost surface which is contiguous with and is integral and unitary with a lower portion of the personalizable stacked tire shaped main ice chest housing 11.

The supporting stand member 28 has a flat planar lowermost surface which is co-planar with a lowermost portion of the wheels 13 and 14.

The flat planar lowermost surface of the supporting stand member 28 is oriented substantially perpendicular to the central vertical axis of the personalizable stacked tire shaped main ice chest 11.

There are provided one or more predetermined areas 16 and 29 for the placement thereon of a personalizable logo or emblem (not shown).

Fabrication may be of standard commercially-available ice chest material.

Alternatively, the main ice chest housing 11, the selectively openable and closable lid member 12, the handle 15, the wheels 13 and 14, insulation and other components may be fabricated from a renewable resource.

More particularly, the main ice chest housing 11 and said selectively openable and closable lid member 12 may be fabricated from a renewable resource, for example, such as corn sugar or a fibrous residue remaining after sugarcane or sorghum stalks are crushed to extract their juice.

A drain 17 is provided at the bottom of said main ice chest housing 11.

A digital recorder 18 may be provided on the underside of said selectively openable and closable lid member 12.

The digital recorder 18 may be provided with preset messages and the ability for the user of said personalizable sports themed ice chest 10 to record additional messages on said digital recorder 18.

One or more speakers 19 and 20 may be provided on the underside of said selectively openable and closable lid member 12.

There has been illustrated in the accompanying drawings and described hereinabove only one possible unique and novel embodiment of the present invention which can be practiced and constructed in many different embodiments, configurations, materials, arrangements of components, sizes, and shapes.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. A personalizable sports themed ice chest, comprising:

a main ice chest housing having a selectively openable and closable lid member pivotably secured to said main ice chest housing;

said main ice chest housing and said selectively openable and closable lid member being formed in a personalizable shape of stacked tires;

wheels rotatably secured to said main ice chest housing under said main ice chest housing to enable said personalizable sports themed ice chest to be rolled by a user of said personalizable sports themed ice chest;

a supporting stand member integral, unitary and contiguous with and depending directly from said personalizable stacked tire shaped main ice chest housing;

said supporting stand member being oriented substantially perpendicular to a central vertical axis of said personalizable stacked tire shaped main ice chest housing;

said central vertical axis of said personalizable stacked tire shaped main ice chest housing being oriented substantially in line with a midpoint of said supporting stand member;

said supporting stand member having an uppermost surface which is contiguous with and is integral and unitary with a lower portion of said personalizable stacked tire shaped main ice chest housing;

said supporting stand member having a flat planar lowermost surface which is co-planar with a lowermost portion of said wheels;

said flat planar lowermost surface of said supporting stand member is oriented substantially perpendicular to said central vertical axis of said personalizable stacked tire shaped main ice chest:

a collapsible pull handle mechanism connected to said main ice chest housing; and one or more predetermined areas on said personalizable stacked tire shaped main ice chest housing for the placement thereon of a logo or emblem.

2. The personalizable sports themed ice chest of claim 1, wherein:

a drain is provided at the bottom of said personalizable stacked tire shaped main ice chest housing.

3. The personalizable sports themed ice chest of claim 2, wherein:

one or more speakers are provided on the underside of said selectively openable and closable lid member.

4. The personalizable sports themed ice chest of claim 3, including:

a digital recorder provided on the underside of said selectively openable and closable lid member.

5. The personalizable sports themed ice chest of claim 4, wherein:

said digital recorder is provided with preset messages and the ability for the user of said personalizable stacked tire shaped ice chest to record additional messages on said digital recorder.

6. The personalizable sports themed ice chest of claim 5, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

7. The personalizable sports themed ice chest of claim 3, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

8. The personalizable sports themed ice chest of claim 2, including:

a digital recorder provided on the underside of said selectively openable and closable lid member.

9. The personalizable sports themed ice chest of claim 8, wherein:

said digital recorder is provided with preset messages and the ability for the user of said personalizable stacked tire shaped ice chest to record additional messages on said digital recorder.

10. The personalizable sports themed ice chest of claim 8, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

11. The personalizable sports themed ice chest of claim 2, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

12. The personalizable sports themed ice chest of claim 1, wherein:

one or more speakers are provided on the underside of said selectively openable and closable lid member.

13. The personalizable sports themed ice chest of claim 12, including:

a digital recorder provided on the underside of said selectively openable and closable lid member.

14. The personalizable sports themed ice chest of claim 13, wherein:

said digital recorder is provided with preset messages and the ability for the user of said personalizable stacked tire shaped ice chest to record additional messages on said digital recorder.

15. The personalizable sports themed ice chest of claim 13, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

16. The personalizable sports themed ice chest of claim 12, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

17. The personalizable sports themed ice chest of claim 1, including:

a digital recorder provided on the underside of said selectively openable and closable lid member.

18. The personalizable sports themed ice chest of claim 17, wherein:

said digital recorder is provided with preset messages and the ability for the user of said personalizable stacked tire shaped ice chest to record additional messages on said digital recorder.

19. The personalizable sports themed ice chest of claim 17, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

20. The personalizable sports themed ice chest of claim 1, wherein:

said personalizable stacked tire shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

* * * * *